US011554945B2

(12) United States Patent
Fitzgerald et al.

(10) Patent No.: US 11,554,945 B2
(45) Date of Patent: Jan. 17, 2023

(54) BEVERAGE DISPENSER

(71) Applicant: De Bortoli Wines Pty Limited, Griffith (AU)

(72) Inventors: Peter Fitzgerald, Elwood (AU); Peter Thatcher, Reservoir (AU); Paul Morrice, Tullamarine (AU)

(73) Assignee: DE BORTOLI WINES PTY LIMITED, Griffith (AU)

( * ) Notice: Subject to any disclaimer, the term of this patent is extended or adjusted under 35 U.S.C. 154(b) by 41 days.

(21) Appl. No.: 17/133,778

(22) Filed: Dec. 24, 2020

(65) Prior Publication Data

US 2021/0114858 A1 Apr. 22, 2021

Related U.S. Application Data

(63) Continuation of application No. 16/092,122, filed as application No. PCT/AU2017/050298 on Apr. 6, 2017, now abandoned.

(30) Foreign Application Priority Data

Apr. 6, 2016 (AU) ..... 2016901271

(51) Int. Cl.
*B67D 1/00* (2006.01)
*B67D 1/08* (2006.01)
(Continued)

(52) U.S. Cl.
CPC ..... *B67D 1/0867* (2013.01); *B65D 77/06* (2013.01); *B65D 77/065* (2013.01);
(Continued)

(58) Field of Classification Search
CPC .. B67D 1/0857; B67D 1/0867; B67D 1/0888; B67D 1/0009; B67D 1/0004; B67D 1/04;
(Continued)

(56) References Cited

U.S. PATENT DOCUMENTS 3,827,256 A 8/1974 Wiesner
4,304,341 A 12/1981 Shirley
(Continued)

FOREIGN PATENT DOCUMENTS

CN 203302867 U 11/2013
EP 1749793 A1 2/2007
(Continued)

OTHER PUBLICATIONS

International Search Report dated Jul. 12, 2017 for corresponding International Application No. PCT/AU2017/050298, filed Apr. 6, 2017.

(Continued)

*Primary Examiner* — Charles P. Cheyney
(74) *Attorney, Agent, or Firm* — David D. Brush; Westman, Champlin & Koehler, P.A.

(57) ABSTRACT

A beverage dispenser for dispensing beverage from one or more beverage units. Each of the beverage units includes a respective beverage unit outlet, and a respective support structure supporting beverage and orienting the respective beverage unit outlet. The dispenser includes a refrigerator in which the beverage unit(s) are receivable; a respective inlet, within the refrigerator, for each of the beverage units; at least one a dispensing outlet for dispensing beverage into drinking vessels; one or more fluid paths from the inlet(s) to the dispensing outlet(s); a guide arrangement co-operable with the support structure(s) to guide the beverage unit(s) so that each respective beverage unit outlet co-operates with its respective inlet to form a respective dry break connection through which beverage is conveyable on route to the dispensing outlet(s) via the fluid path(s).

19 Claims, 5 Drawing Sheets

(51) Int. Cl.

| | |
|---|---|
| ***B67D 1/04*** | (2006.01) |
| ***B67D 1/06*** | (2006.01) |
| ***F25D 17/06*** | (2006.01) |
| ***F25D 23/12*** | (2006.01) |
| ***F25D 31/00*** | (2006.01) |
| ***B65D 77/06*** | (2006.01) |

(52) U.S. Cl.
CPC ..... *B67D 1/0004* (2013.01); *B67D 1/04* (2013.01); *B67D 1/06* (2013.01); *B67D 1/0807* (2013.01); *B67D 1/0829* (2013.01); *B67D 1/0868* (2013.01); *B67D 1/0892* (2013.01); *F25D 17/06* (2013.01); *F25D 23/12* (2013.01); *F25D 31/002* (2013.01); *B67D 2001/0097* (2013.01); *B67D 2001/0827* (2013.01); *B67D 2210/00031* (2013.01); *B67D 2210/00041* (2013.01); *B67D 2210/00104* (2013.01); *B67D 2210/00118* (2013.01)

(58) Field of Classification Search
CPC ..... B67D 1/06; B67D 1/0807; B67D 1/0829; B67D 1/0868; B67D 1/0892; B67D 2001/0827; B67D 2001/0097; B67D 2210/00031; B67D 2210/00041; B67D 2210/00104; B67D 2210/00118
USPC ..... 222/146.1, 132, 105
See application file for complete search history.

(56) References Cited

U.S. PATENT DOCUMENTS

| | | | | |
|---|---|---|---|---|
| 5,492,250 | A | 2/1996 | Sardynski | |
| 5,575,405 | A | 11/1996 | Stratton et al. | |
| 5,816,298 | A | 10/1998 | Stricklin et al. | |
| 5,884,648 | A | 3/1999 | Savage | |
| 6,105,825 | A | 8/2000 | Gomi et al. | |
| 6,644,367 | B1 | 11/2003 | Savage et al. | |
| 6,938,801 | B1 * | 9/2005 | Reddy | B67D 1/0078 222/529 |
| 7,743,624 | B2 | 6/2010 | Schneller et al. | |
| 7,762,431 | B1 * | 7/2010 | Tuyls | F25D 31/002 222/148 |
| 8,464,903 | B2 | 6/2013 | Baker | |
| 8,596,496 | B2 * | 12/2013 | Malinski | B67D 3/0038 222/105 |
| 8,640,931 | B2 | 2/2014 | O'Keefe, Jr. et al. | |
| 8,820,094 | B1 * | 9/2014 | Casher | B67D 3/008 62/3.2 |
| 8,857,666 | B2 * | 10/2014 | O'Keefe, Jr. | B67D 1/0885 222/37 |
| D732,872 | S | 6/2015 | Kalik et al. | |
| 9,771,252 | B2 | 9/2017 | Hunter | |
| 10,035,111 | B2 | 7/2018 | Jarrousse et al. | |
| 11,034,569 | B2 * | 6/2021 | Kaplan | B67D 1/0888 |
| 2003/0062386 | A1 * | 4/2003 | Derry | B67D 1/0868 62/389 |
| 2004/0129720 | A1 | 7/2004 | Cheng et al. | |
| 2004/0177893 | A1 | 9/2004 | Younkle | |
| 2010/0199709 | A1 | 8/2010 | Holland et al. | |
| 2010/0276443 | A1 * | 11/2010 | Baker | B67D 1/0867 222/1 |
| 2013/0047557 | A1 * | 2/2013 | Johnson | B65D 75/5872 222/501 |
| 2014/0048559 | A1 | 2/2014 | Malinski | |
| 2014/0144935 | A1 | 5/2014 | O'Keefe, Jr. et al. | |
| 2015/0048118 | A1 | 2/2015 | English et al. | |
| 2015/0321893 | A1 * | 11/2015 | Corbelli | G01F 11/125 222/1 |
| 2016/0159633 | A1 | 6/2016 | Diffenderfer | |
| 2016/0175785 | A1 * | 6/2016 | Li | B01F 35/2209 99/323.1 |
| 2017/0203946 | A1 * | 7/2017 | Henriquez | B67D 1/0892 |
| 2017/0203949 | A1 * | 7/2017 | Henriquez | B67D 1/0892 |
| 2017/0240399 | A1 * | 8/2017 | Blank | B67D 1/0004 |
| 2017/0291808 | A1 * | 10/2017 | Young | B67D 1/0004 |
| 2017/0362071 | A1 * | 12/2017 | Showalter | B67D 1/0804 |

FOREIGN PATENT DOCUMENTS

| | | | |
|---|---|---|---|
| FR | 2949552 | A1 | 3/2011 |
| WO | 2004099060 | A2 | 11/2004 |
| WO | 2009142498 | A2 | 11/2009 |
| WO | 2011061343 | A1 | 5/2011 |
| WO | 2013122933 | A1 | 8/2013 |

OTHER PUBLICATIONS

Written Opinion of the International Searching Authority dated Jul. 12, 2017 for corresponding International Application No. PCT/AU2017/050298, filed Apr. 6, 2017.
International Preliminary Report on Patentability of the International Searching Authority dated Aug. 16, 2017 for corresponding International Application No. PCT/AU2017/050298, filed Apr. 6, 2017.
International-Type Search Report dated Mar. 7, 2017 from the Australian Patent Office for Australian Application No. 2016901271, filed Apr. 6, 2016.
International-Type Search Report dated Feb. 7, 2017 from the Australian Patent Office for Australian Application No. 2016901271, filed Apr. 6, 2016.
Office Action dated Mar. 2, 2020 for corresponding U.S. Appl. No. 16/092,122, filed Oct. 8, 2018.
Final Office Action dated Aug. 24, 2020 for corresponding U.S. Appl. No. 16/092,122, filed Oct. 8, 2018.
Advisory Action dated Nov. 12, 2020 for corresponding U.S. Appl. No. 16/092,122, filed Oct. 8, 2018.

* cited by examiner

BEVERAGE DISPENSER

CROSS-REFERENCE TO RELATED APPLICATIONS

This Application is continuation of U.S. application Ser. No. 16/092,122, filed Oct. 8, 2018, which is a Section 371 National Stage Application of International Application No. PCT/AU2017/050298, filed Apr. 6, 2017 and published as WO 2017/173495 A1 on Oct. 12, 2017, in English, the contents of which are incorporated herein by reference in their entireties.

FIELD

The inventors have developed a new refrigerated beverage-dispenser various aspects may be usefully applied in other contexts.

BACKGROUND

In some establishments wine is sold by the glass. This process is notoriously inefficient. Wine bottles are bulky whereas frequently space is limited in such establishments. Wine deteriorates once exposed to oxygen thus once a bottle of wine has been opened for the service of a single glass the remainder of the bottle starts to deteriorate and if it is not sold promptly must be thrown out. Wastage is common.

Different wines have different ideal service temperatures and small deviations from the ideal temperature can have a significant detrimental effect on the drinker's enjoyment of the beverage. As such wine bottles are often stored in temperature controlled cabinets.

The inventors have observed that some of these cabinets are energy inefficient and subject the wine to fluctuating temperatures whereas a stable temperature profile is preferred.

The service areas in many wine serving establishments can be very busy during peak times. It would be highly desirable to provide a more convenient means for the service of wine to ease the burden on service personnel.

Dual zone refrigerators are known in contexts other than beverage dispensing. They typically include a higher-temperature zone located underneath a lower-temperature zone and fluidly connected by a vent through which cold air can fall into the higher-temperature zone. Typically the evaporator of the refrigeration mechanism acts on the lower-temperature zone whilst a separate heating apparatus is operated in the lower-temperature zone to maintain the temperature within that zone.

Typically the heating apparatus is activated and deactivated in response to the temperature in the higher-temperature zone passing a threshold temperature. The inventors' studies have shown that this arrangement is inefficient as the evaporator and the heater tend to work against each other and also results in an unstable temperature profile in the higher-temperature zone.

It is not admitted that any of the information in this patent specification is common general knowledge, or that the person skilled in the art could be reasonably expected to ascertain or understand it, regard it as relevant or combine it in any way before the priority date.

SUMMARY

One aspect of the invention provides a beverage dispenser for dispensing beverage from one or more beverage units;

each of the beverage unit(s) including
- a respective beverage unit outlet; and
- a respective support structure supporting beverage and orienting the respective beverage unit outlet;

the dispenser including
- a refrigerator in which the beverage unit(s) are receivable;
- a respective inlet, within the refrigerator, for each of the beverage units;
- at least one dispensing outlet for dispensing beverage into drinking vessels;
- one or more fluid paths from the inlet(s) to the dispensing outlet(s);
- a guide arrangement co-operable with the support structure(s) to guide the beverage unit(s) so that each respective beverage unit outlet co-operates with its respective inlet to form a respective dry break connection through which beverage is conveyable on route to the dispensing outlet(s) via the fluid path(s).

Some variants of the described guide arrangement and dry break connection may also be advantageously applied to the distribution of fluids other than beverages and/or to fluid distribution systems that are unrefrigerated. Preferably the dispenser is for dispensing beverage from two or more of the beverage units.

Preferably each respective inlet respectively includes a tubular projection configured to penetrate a membrane, of the respective beverage unit outlet with which the respective inlet is co-operable, to form the respective dry break connection.

One or more pumps may be arranged to drive beverage along the fluid path(s).

Another aspect of the invention provides a beverage dispenser including
- a refrigerator in which beverage is stowable;
- at least one dispensing outlet for dispensing beverage into drinking vessels;
- one or more fluid paths for conveying the stowed beverage to the dispensing outlet(s); and
- one or more pumps arranged to drive beverage the along fluid path(s);

wherein at least one of the pump(s) is positioned to be refrigerated by the refrigerator.

Preferably each of the pumps has beverage-contacting portions; and the at least one of the pump(s) is positioned to be refrigerated by the refrigerator such that, at steady state without the beverage to be driven by the at least one of the pumps being dispensed, the beverage-contacting portions of the at least one of the pumps are no warmer than about a same temperature as the beverage to be driven by the at least one of the pumps.

Another aspect of the invention provides a beverage dispenser including
- a refrigerator in which beverage is stowable;
- at least one dispensing outlet for dispensing beverage into drinking vessels;
- one or more fluid paths for conveying the stowed beverage to the dispensing outlet(s);
- one or more pumps arranged to drive beverage the along fluid path(s); and
- a settling vessel downstream of at least one of the pumps.

The settling vessel preferably has a volume of at least 80 cc, and most preferably a volume of more than 150 cc.

The settling vessel may be a settling tube having an internal cross section of at least 1.5 $cm^2$. Preferably the internal cross section is not more than about 7 $cm^2$. The settling tube preferably has a wall thickness of at least 1 mm.

Most preferably the wall thickness is about 1.6 mm. The settling vessel may be positioned to be refrigerated by the refrigerator, e.g. the settling vessel may be positioned to be refrigerated by the refrigerator such that, at steady state without the beverage to be driven by the at least one of the pumps being dispensed, beverage within the settling vessel is no warmer than about the same temperature as the beverage to be driven by the at least one of the pumps.

The pump(s) may be vacuum pumps and/or pressure actuatable.

Another aspect of the invention provides a beverage dispenser including a refrigerator in which beverage is stowable;

at least one dispensing outlet for dispensing beverage into drinking vessels;

one or more fluid paths for conveying the stowed beverage to the dispensing outlet(s);

a fan; and a tubular portion;

wherein the refrigerator includes a refrigeration mechanism for cooling air to form cooled air;

at least one of the fluid paths is partly defined by a portion of conduit embraced by the tubular portion; and the fan is arranged to move the cooled air through the tubular portion to cool the portion of the conduit.

The tubular portion is preferably a portion of a fluid circuit about which air is circulated. The fluid circuit may include an air-conveying conduit running along and within the tubular portion. The air-conveying conduit may be a return line within which air that has cooled the portion of the conduit is returned to the refrigeration mechanism. The dispenser may include a font. The tubular portion may include a stem of the font.

Preferably the refrigerator includes a higher-temperature zone for one or more beverages and a lower-temperature zone for another one or more beverages.

Another aspect of the invention provides a beverage dispenser, for dispensing beverage, including a refrigerator in which beverage is stowable;

at least one a dispensing outlet for dispensing beverage into drinking vessels; and two or more fluid paths for conveying the stowed beverage to the dispensing outlet(s);

wherein the refrigerator includes a higher-temperature zone and a lower-temperature zone; and the higher-temperature zone is substantially-fluidly-isolated from, and thermally connected to, the lower-temperature zone by a thermally-conductive wall.

Preferably the dispenser includes a higher-temperature zone temperature sensor for sensing the temperature in the higher-temperature zone;

a heating apparatus for heating the higher-temperature zone; and a control arrangement for controlling the heating apparatus in response to the higher-temperature zone temperature sensor.

The control arrangement for controlling the heating apparatus may be configured to activate the heating apparatus in response to the temperature in the higher-temperature zone reaching an activation temperature; and deactivate the heating apparatus in response to the temperature in the higher-temperature zone reaching a deactivation temperature;

the deactivation temperature being higher, e.g. 0.25° C. to 0.75° C. higher, than the activation temperature.

Alternatively the control arrangement for controlling the heating apparatus may be configured to control the heating apparatus to whilst active vary its output in response to the temperature in the higher-temperature zone, e.g. the power output of the heating apparatus may be proportional to (or another function of) a difference between the actual temperature and the desired temperature.

The dispenser preferably includes a lower-temperature zone temperature sensor for sensing the temperature in the lower-temperature zone;

a cooling apparatus for cooling the lower-temperature zone; and a control arrangement for controlling the cooling apparatus in response to the lower-temperature zone temperature sensor.

Another aspect of the invention provides a beverage unit, for a beverage dispenser, including a sealed bag, for holding beverage, having an outlet; and a support structure to support the bag, orient the outlet and co-operate with a guide arrangement for guiding the unit so that the outlet cooperates with an inlet to form a dry break connection through which the beverage is conveyable on route to a dispensing outlet(s);

wherein the outlet includes a membrane penetrable, by a tubular projection of the inlet, to form the dry break connection.

Another aspect of the invention provides a beverage unit, for a beverage dispenser, including a sealed bag, for holding beverage, having an outlet; and a support structure to support the bag, orient the outlet and co-operate with a guide arrangement for guiding the unit so that the outlet cooperates with an inlet to form a dry break connection through which the beverage is conveyable on route to a dispensing outlet(s) wherein the outlet defines an outwardly open annular groove into which portions of the support structure are receivable to so orient the outlet.

The support structure may be a box. Alternatively it may be a metallic drawer. Preferably it is at least predominantly formed of cardboard. Cardboard is advantageously collapsible for convenient disposal. Other collapsible modes of construction are possible.

The unit may hold wine.

Another aspect of the invention provides a beverage dispenser carrying at least one beverage unit.

Another aspect of the invention provides a method of dispensing wine including utilizing a dispenser.

Also disclosed is a beverage dispenser, for dispensing beverage, including a refrigerator, including a higher-temperature zone and a lower-temperature zone, in which beverage is stowable;

at least one a dispensing outlet for dispensing beverage into drinking vessels;

two or more fluid paths for conveying the stowed beverage to the dispensing outlet(s);

a higher-temperature zone temperature sensor for sensing the temperature in the higher-temperature zone;

a heating apparatus for heating the higher-temperature zone; and a control arrangement configured to control the heating apparatus in response to the higher-temperature zone temperature sensor to at least one of:

A) control the heating apparatus to whilst active vary its output in response to the temperature in the higher-temperature zone; and B) activate the heating apparatus in response to the temperature in the higher-temperature zone reaching an activation temperature; and deactivate the heating apparatus in response to the temperature in the higher-temperature zone reaching an deactivation temperature;

the deactivation temperature being higher than the activation temperature.

The foregoing improvements in dual-zone refrigeration may be applied to refrigerators (and/or other cooling apparatus) other than beverage dispensers, e.g. to refrigerators for storing vegetables.

Also disclosed is a beverage unit, for a beverage dispenser, including a sealed bag, for holding beverage, having an outlet; and a support structure to support the bag, orient the outlet and co-operate with a guide arrangement for guiding the unit so that the outlet cooperates with an inlet to form a dry break connection through which the beverage is conveyable on route to a dispensing outlet(s).

BRIEF DESCRIPTION OF DRAWINGS

An embodiment of the apparatus will now be described by way of example only with reference to the accompanying drawings in which.

DESCRIPTION OF EMBODIMENTS

Figure 1:
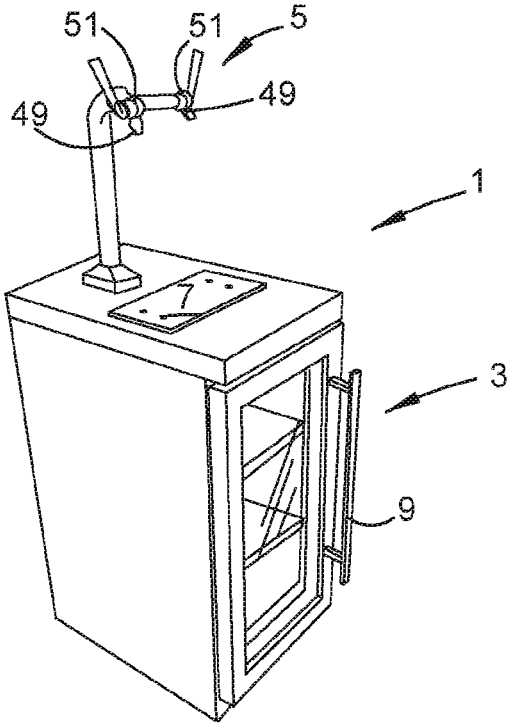
FIG. 1 is a perspective view of a beverage dispenser.
Figure 2:
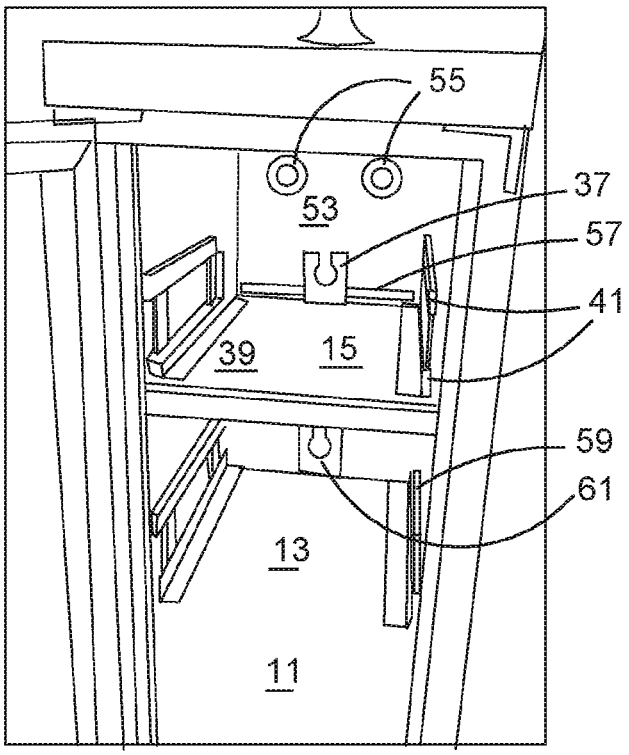
FIG. 2 is a front view of the beverage dispenser of FIG. 1 with its door open.

The beverage dispenser 1 includes a refrigerated cabinet 3 and, mounted atop the cabinet 3, a font 5 and drip tray 7. The cabinet 3 is closed by a door 9 at its front. A lockable drawer 11 is mounted within and at the base of the cabinet 3. A higher-temperature zone 13 is situated immediately above the drawer 11. A lower-temperature zone 15 is mounted immediately above the higher-temperature zone 13.

Figure 3:
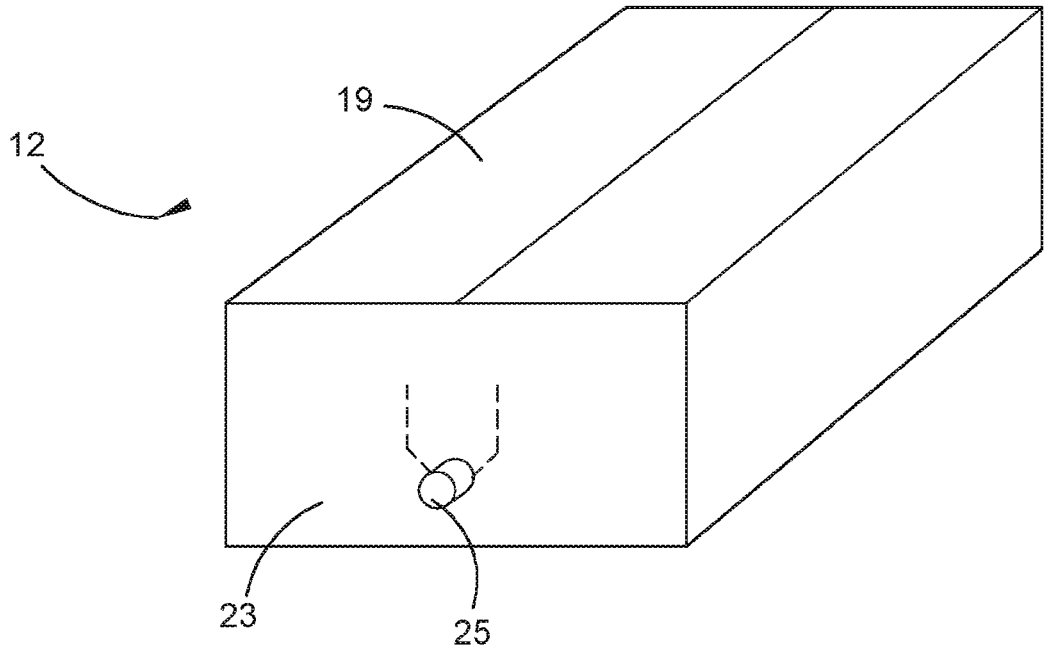
FIG. 3 is a perspective view of a beverage unit.
Figure 4:
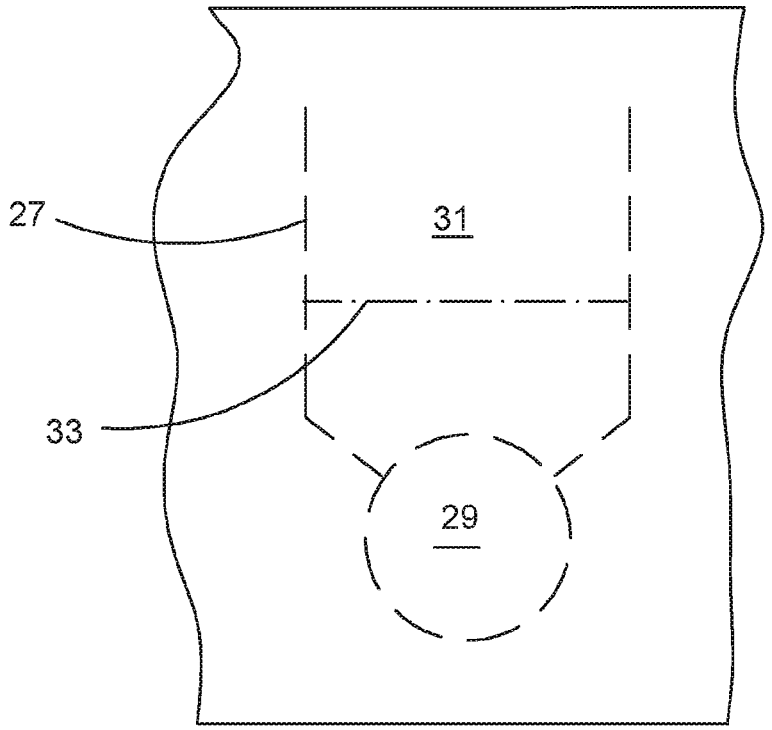
FIG. 4 is a close up front view of the beverage unit.
Figure 5:
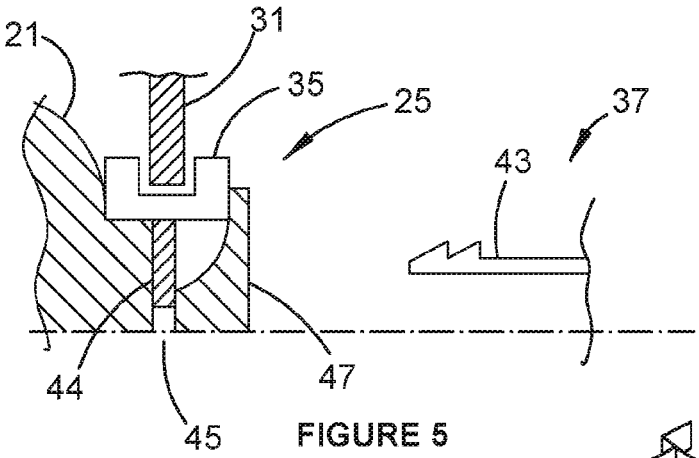
FIG. 5 is a half cross section view of an outlet and an inlet.

The dispenser 1 is for dispensing beverage from beverage units such as the unit 17 of FIG. 3. The unit 17 includes a support structure in the form of cardboard box 19 which internally carries, and supports, a beverage filled bag 21 (FIG. 5). The box 19 is a six-sided box including a rectangular front face 23. The bag 21 includes an outlet 25.

Typically the bag 21, including its outlet 25, would be sealed within the box 19 at a factory for transport to a beverage dispensing venue. At that venue the unit 17 would be reconfigured to present the outlet 25. For this purpose the front face 23 includes lines of weakness 27 (such as perforated lines) along which the front face 23 may be broken with simple hand manipulation to remove a disk 29 and define a flap 31. The flap 31 is transversely bisected by a fold line 33.

The flap 33 can be readily lifted away from the box 19 so that the outlet 25 can be grasped and partly withdrawn from the box 19. The outlet 25 includes a plastic collar 35 defining an outwardly open annular groove. With suitable hand manipulation the collar 35 can be maneuvered so that the disk 29 can be replaced by the collar 35 with the material of the front 23 mating within the outwardly open annular groove of the collar 35. Then flap 31 is temporarily folded along the fold line 33 to also enable its free end to fit within the groove of the collar 35. By pushing the fold line 33 to flatten the flap 31 the collar 35 can be firmly engaged so that the orientation of the outlet 25 is fixed. The outlet 25 is thus oriented by the box 19. To complete the reconfiguration a cap 47 is then removed from the outlet 25.

The cabinet 3 includes a guide arrangement co-operable with the box 19 to guide the outlet 25 onto an inlet 37 mounted at the rear of the cabinet 3.

In the upper temperature zone 15 the guide arrangement includes the floor 39 of the zone 15 and a pair of rails 41 running fore and aft within and along, and on each side of, the higher-temperature zone 15. The rails 41 include outwardly splayed front end portions to define a lead-in.

The inlet 37 includes a barbed tubular projection 43 projecting forwardly from a bracket by which it is fixed relative to the guide arrangement 39, 41. Modes of fixation other than a bracket are possible.

To install the reconfigured unit 17 in the dispenser 1, a user simply places the unit 17 on the shelf-like floor 39 with the outlet 25 exposed at the rear and towards the base of the unit 17. A user then need only rearwardly slide the unit 17 along the guide arrangement 39, 41.

The outlet 25 includes a membrane 43 spanning the interior of the collar 35. The membrane has a pair of slots 45 arranged in a cross pattern at the membrane's center. In its free condition the membrane is substantially planar so that it slots 45 are closed and the bag 21 is thereby sealed. In transit the outlet 25 is fitted with the cap 47 which bears against the outside of the membrane 43 to resist outward bulging of the membrane 43, and the associated opening of the slits 45, if the bag 21 is compressed so that the bag 21 remains sealed. Suitable outlets are sold under the trade mark Scholle.

With the cap 47 removed the simple rearward translation of the unit 19 along the guide arrangement 39, 41 causes the projection 43 to penetrate the membrane 44. The outlet 25 is thus impaled on the projection 43 without the user giving specific attention to alignment of the outlet 25.

The inlet 37 is thus fluidly connected with the interior of the bag 41. This connection is effected without any significant leakage. The connection thus constitutes a dry break connection.

Figure 6:
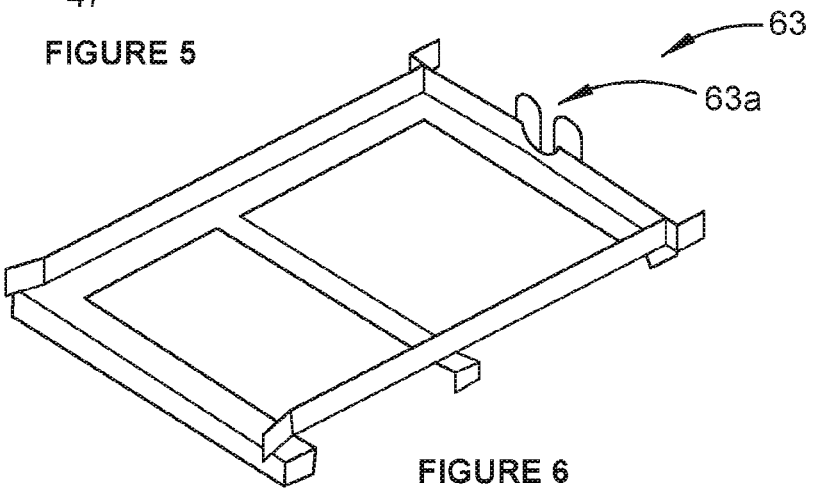
FIG. 6 is a perspective view of a tray.

FIG. 6 shows a tray 63 which may form part of the support structure in an alternate form of beverage unit. The tray 63 is a steel frame construction into which the box 19 and bag 21 are receivable. A rear of the tray 63 includes a collar-receiving formation 63*a* which in this example takes the form of a U-shaped opening. To create the alternate beverage unit the flap 31 may be torn away from the box 19, the box 19 placed into the tray and the collar 35 manoeuvred to engage with the formation 63*a*. The frame 63 thus serves to orient the outlet 25. As suggested in FIG. 7, the guide arrangement may be inclined to urge the beverage units to slide to the rear.

Of course other forms of beverage unit are possible. By way of example, the bag 21 might be removed from the box 19 and placed into a suitable variant of the tray 63 whilst the box 19 is simply discarded.

The font 5 includes a respective dispensing outlet 49 for each of the inlets 37. Each of the outlets 49 has its own tap 51 openable to permit beverage to flow from the outlet into a drinking vessel such as a wine glass.

A pair of pumps is mounted within the lockable drawer 11. Suitable plumbing connects each of the inlets 37 with its respective one of the outlets 49 via a respective one of the pumps. Preferably the pumps are vacuum pumps capable of sucking substantially all of the beverage from the bags 21 so that there is minimal wastage. Advantageously the pumps are pressure actuatable so that they remain dormant most of the time but begin pumping the moment that a pressure drop resultant from the tap 51 being opened is detected. Suitable pumps are sold under the trade mark Xylem. The pumps are locked away within the drawer 11 to prevent tampering by beverage-service staff whilst allowing technicians to conveniently access the pumps if need be.

A wall 53 at the rear of the lower-temperature zone 15 separates an interior of the zone from a cooling apparatus in the form of a refrigeration mechanism. Other forms of cooling apparatus are possible.

Two fans 55 are mounted within respective openings through, and close to the top of, the wall 53. A long rectangular opening 57 opens through the wall 53 and sits horizontally and adjacent to the floor 39.

The fans 55 are 60 mm 12 volt DC fans and are configured to drive air from the refrigeration mechanism into the interior of the zone 15. The air is returned to the refrigeration mechanism via the opening 57. Air is thus cycled over the evaporator of the refrigeration mechanism.

The unit 17 clears the side walls and the ceiling of the zone 15 by about 20 mm. The fans 55 are positioned towards the top of the wall 53 so as to blow cold air from the refrigeration mechanism outwardly along the ceiling towards the front of the zone 15 to cool the front of the unit 17. The air tends to return along the sides of the unit 17. Thus cold air is circulated over the exterior of the unit 17 so as to more effectively cool the unit than if cold air were allowed to stagnate at the rear of the zone 15.

The floor 39 is a stainless steel plate in the vicinity of 5 mm thick and sits in close proximity to the door 3 and the internal walls of the zone 15 (and does not have any significant openings passing through it) so that the zone 15 is substantially fluidly isolated from the zone 13. As such cold air cannot rush down from the zone 15 to cool the zone 13. Instead the thermal conductivity of the 439 provides for a slower more controlled transfer of heat between the zones 13, 15.

A rear wall 61 separates the higher-temperature zone 13 from a resistance coil of a heating apparatus. The heating apparatus includes a single 60 mm fan (not shown) centrally mounted within, and towards the top edge of, the wall 61 to blow heated air over the top of a unit 17. The air is returned to the resistance coil via an opening 61, through the wall 59, akin to the opening 57. Whilst the described the heating apparatus includes a resistance coil, it is conceivable that the heating apparatus may include the condenser of the refrigeration apparatus, e.g. activating the heating apparatus may consist of selectively communicating the condenser with the zone 13.

Preferably each of the temperature zones has its own control arrangement which operates substantially independently of the other. This enables simple control arrangements which are readily and cost-effectively available to be used. In this example each of the two controllers is a carel IR33+ controller.

The controller of the lower-temperature zone receives an output from a temperature sensor in the form of a thermocouple in that zone and activates and deactivates the refrigeration mechanism and fans 55 in response to the measured temperature passing a selected temperature. E.g. the zone 15 may be thermostatically maintained at 4° C. to suit white wine.

The controller of the higher-temperature zone 13 receives an input from a thermocouple mounted in that zone but rather than simple thermostatic control, the heater is activated when the temperature in the zone falls below an activation temperature, say 18° C. to suit red wine, but continues heating until a relatively higher deactivation temperature, say 18.5° C., is reached. This has been found to minimise the frequency at which the heater is activated and deactivated which leads to improved energy efficiency and a less erratic temperature profile within the higher-temperature zone.

Testing of early prototypes of the beverage dispenser revealed previously unforeseen drawbacks. The dispensed wine sometimes had an undesirable cloudy appearance. Moreover the first pour of wine after that particular wine had not been dispensed in some hours was often too warm. To address these non-obvious problems the present inventors have pursued a three-pronged approach.

Figure 7:
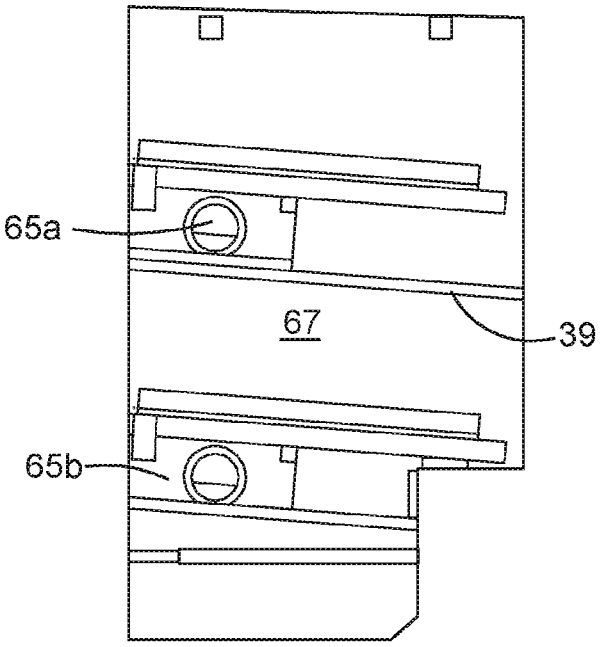
FIG. 7 is a schematic cross-section view of a refrigerator.
Figure 8:
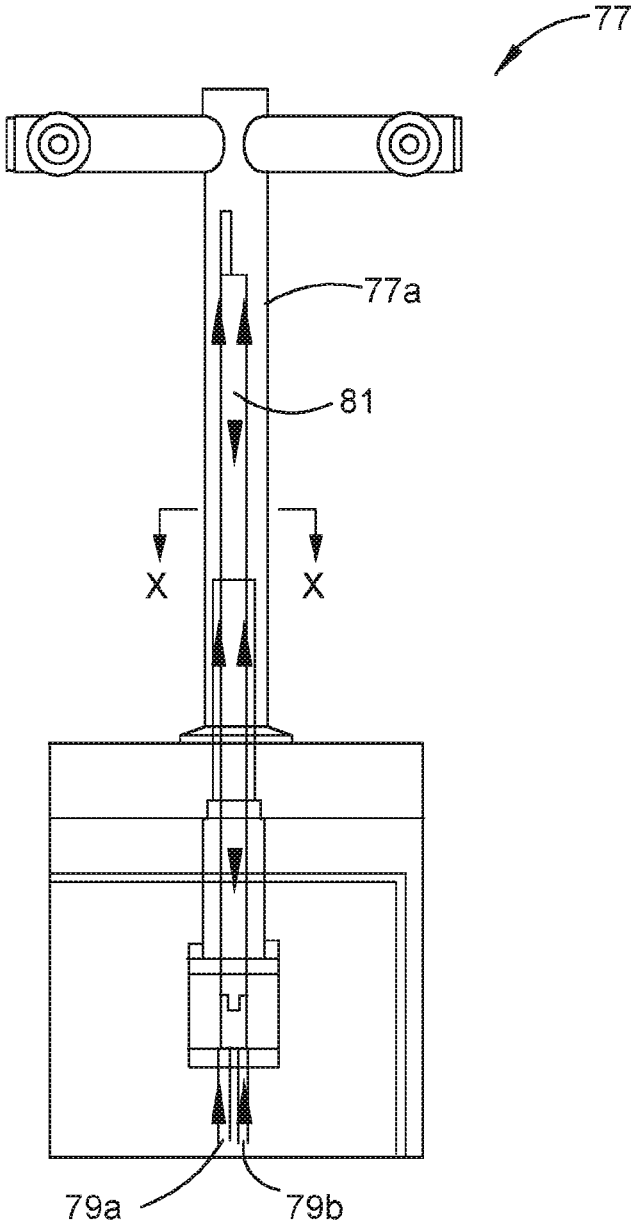
FIG. 8 is a schematic front view of a font.
Figure 9:
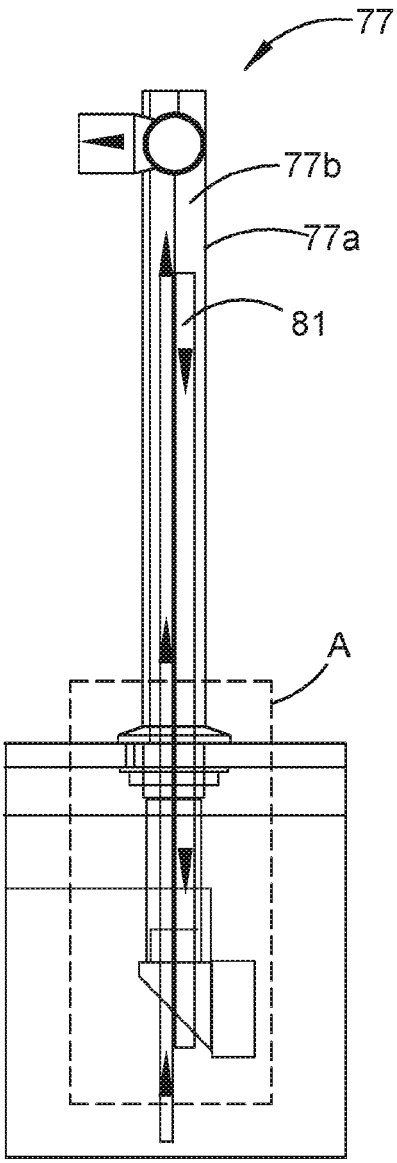
FIG. 9 is a schematic side view of the font.
Figure 10:
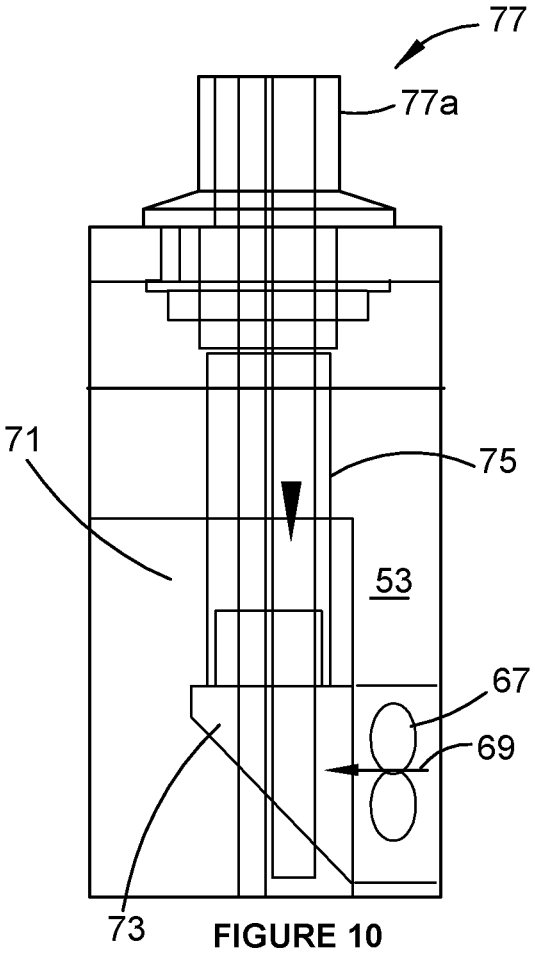
FIG. 10 is an enlargement of detail A in FIG. 9.
Figure 11:
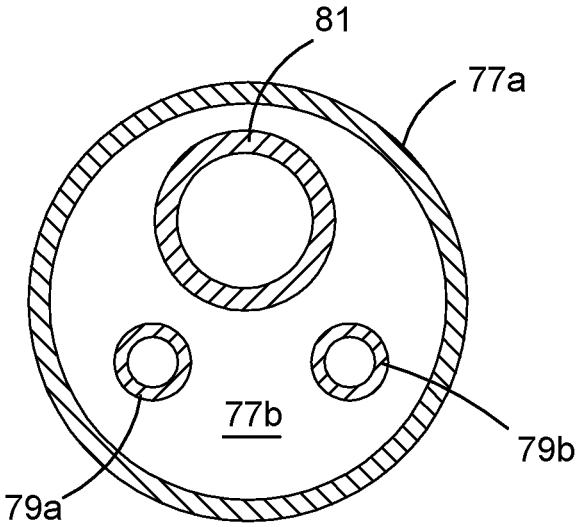
FIG. 11 is a cross-section view corresponding to the line X-X in FIG. 8.

Firstly as suggested in FIG. 7 the pumps 65*a*, 65*b* have been moved into the refrigerated space 67 so that their wine contacting portions remain at about the same temperature as the refrigerated wine when the pump is inactive. The present inventors have recognised that after a number of hours of inactivity the pumps were much warmer than the refrigerated wine and the beverage contacting portions of the pump had enough thermal mass to heat the first pour by about 2° C.

In the described example substantially all of each of the pump 65*a*, 65*b* is bathed in cooling air. As such the beverage units are bathed in cooling air to a similar extent to the beverage units. This arrangement is simply convenient although it is in principle possible that only selected portions, e.g. only the beverage contacting portions, are exposed to the refrigerator's cooling air.

It has also been recognised that the volume of wine held within the font 49 warms after an extended period without movement of that wine. This is another factor contributing to the first pour of wine being too warm.

In the context of dispensing beer it is known to cool the font with a dedicated refrigerated glycol system. Rather than adopting the known glycol system, the present inventors have recognised that significant cost savings can be realised by using the air cooled by the refrigerator to cool the font. This has been found to be particularly advantageous in the context of serving wine which is typically served at a higher temperature than beer.

Turning to FIGS. 8 to 11, a fan 67 is mounted within the rear wall 53 to drive air from the refrigeration mechanism and into an air guiding arrangement 71. The air guiding arrangement 71 includes a turning manifold 73 which receives the horizontally directed air 69 from the fan 67 and redirects that air upwards. The arrangement 71 further includes a tube 75 to convey the upwardly directed air into the base of the font 77.

The font 77 includes a tubular stem 77*a* internally carrying wine-conveying tubes 79*a*, 79*b* and air-conveying tube 81. The air-conveying tube 81 is a simple tube having a top end opening, to an interior 77*b* of the stem 77, towards the top of the stem 77*a*. A bottom of the tube 81 passes through a suitable aperture in the inclined wall of the turning manifold 73 and opens into the interior space of the refrigerator in which the beverage is stowed.

The air-conveying conduit 81 thus constitutes a return line of a fluid circuit about which the fan 67 circulates air. The air driven by the fan 67 and upwardly turned by the turning arrangement 71 is conveyed upwardly through the interior 77*b* and then returns down the stem 77*a* via the interior of the return line 81. From the line 81, the returning air emerges into the beverage carrying interior of the refrigerator. The air subsequently passes through the opening 57 and through the refrigeration mechanism before returning to the fan 67 to complete the circuit.

The operation of this fluid circuit results in the portions of the wine-conveying tubes 79*a*, 79*b* within the stem 77*a* being externally bathed in cooling air so that after a few hours without a drink being poured, i.e. when the wine in these tubes has reached steady state temperature, it is not more than about the same temperature as the wine within the refrigerated beverage units, e.g. it is within 2° C. or so. By way of example for some white wines 4° C. is considered to be an ideal service temperature and 7° C. is considered to a maximum acceptable service temperature. The present inventors regard it as important that the first pour be at an acceptable service temperature so that that pour is not wasted and so that publicans do not have to train and supervise their staff to monitor the temperature of the dispensed wine etc.

Of course the disclosed principles are readily generalised, by way of example the fan could drive air into the line 81 so that it may subsequently return externally to the line 81 to cool the conduits 79*a*, 79*b* upon its return path. In yet other variants, the line 81 could be replaced by a suitable vent to atmosphere at the top of the stem 77 so that the air conveyed by the fan 67 does not complete a return circuit but is instead simply vented to atmosphere.

The stem 77*a* is a tubular portion in which the wine conveying tubes 79*a*, 79*b* are cooled. Other tubular portions are possible. Whilst in the illustrated examples the font is mounted directly above the refrigerated space some separation in other variants is contemplated. The font might be mounted a few metres away from the refrigerator and connected to the refrigerator with a suitable flexible conduit embracing the conduits 79*a*, 79*b*, 81.

It is also possible that the tube 81 might be mounted externally to the stem 77*a* (or similar tubular portion in which the wine conveying conduit portions are cooled).

Figure 12:
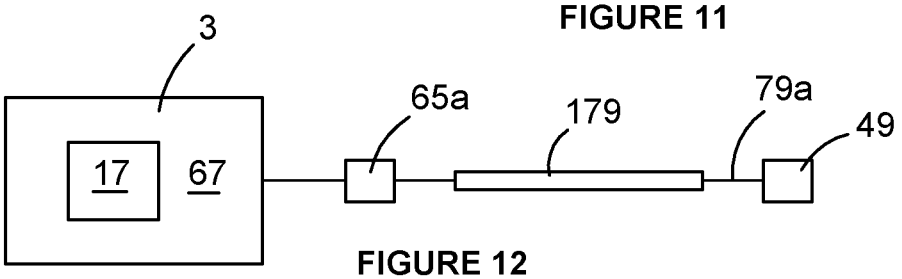
FIG. 12 schematically illustrates a beverage dispenser.

Preferably a respective settling vessel 179 (shown in FIG. 12) is mounted within each of the temperature zones. Each settling vessel is on the downstream side of a respective one of the pumps to receive wine therefrom. Each settling vessel has an inlet to receive the wine and an outlet to dispatch the wine to one of the conduits 79*a*, 79*b*.

The conduits 79*a*, 79*b*, and the conduits connecting the beverage units to the pumps are ¼ inch flexible plastic conduit. The settling vessel defines a flow path of enlarged cross-section to cause the wine to slow and thereby settle. This has been found to address the cloudiness of the dispensed wine. The present inventors have recognised that the cloudiness is associated with the agitation of the wine as it moves through the pump. The settling vessel allows the cloudiness to settle out of the wine.

A preferred form of the settling vessel takes the form of a stainless steel tube having a nominal diameter of a ¾ inch and being about 800 mm long. The tube has a wall thickness of about 1.6 mm. Of course other food grade materials could be used. Stainless steel is preferred because it is both thermally massive and thermally conductive to counteract any heating effect of the pump whilst in operation and to go some way to improving the situation if a beverage unit is installed without first being properly refrigerated. Of course other materials with suitable thermal properties could be used.

A settling vessel having capacity of at least 80 cc is preferred although it is more preferable if the vessel has a capacity of more than 150 cc, i.e. has a capacity of more than a small wine glass. The settling tube is advantageously formed into a rectangular shape and mounted at the ceiling of its temperature zone.

As shown in FIG. 7 the floor 39 in the form of a thermally conductive but fluidly isolating steel plate separates the upper and lower regions of the refrigerator. In this example the floor is separated from the beverage-unit guiding portions. The plate 39 is advantageously removable so that a refrigerator can be readily reconfigured between a dual temperature-zone configuration and a single temperature-zone configuration.

Whilst examples of the invention have been described, the invention is not limited to these examples. The unit 1 could be usefully employed to dispense beverages other than wine, e.g. dispensing milk could be advantageous in the context of a busy café. The beverage dispenser could take the form of an automatic beverage dispenser. As will be apparent to the skilled reader, various of the disclosed advantageous features have application beyond beverage dispensing and indeed even beyond fluid distribution. The described refrigerator may be sold separately to the font.

The invention claimed is:

1. A beverage dispenser for dispensing beverage from one or more beverage units;

each of the one or more beverage units including:

a respective sealed bag holding beverage;

a respective beverage unit outlet; and a respective support structure supporting beverage and orienting the respective beverage unit outlet;

the dispenser including:

a refrigerator in which the one or more beverage units are receivable;

a respective inlet, within the refrigerator, for each of the beverage units;

at least one dispensing outlet for dispensing beverage into drinking vessels;

one or more fluid paths from each respective inlet to the at least one dispensing outlet;

one or more pumps positioned to be refrigerated by the refrigerator and arranged to drive beverage along the one or more fluid paths;

a plurality of settling vessels, each settling vessel being positioned downstream of at least one of the pumps, defining a flow path of enlarged cross-section to cause the beverage to slow and thereby settle, and positioned to be refrigerated by the refrigerator; and a guide arrangement co-operable with each respective support structure to guide the one or more beverage units so that each respective beverage unit outlet co-operates with its respective inlet to form a respective dry break connection through which beverage is conveyable on route to the at least one dispensing outlet via one of the fluid paths, wherein the guide arrangement includes a floor separating the refrigerator into a higher-temperature zone and a lower-temperature zone, and wherein at least one of the plurality of settling vessels is associated with each of the temperature zones.

2. The dispenser of claim 1 wherein each respective inlet respectively includes a tubular projection configured to penetrate a membrane, of the respective beverage unit outlet with which the respective inlet is co-operable, to form the respective dry break connection.

3. The dispenser of claim 1 wherein at least one of the settling vessels has a volume of at least 80 cc.

4. The dispenser of claim 1 wherein at least one of the settling vessels has a volume of more than 150 cc.

5. The dispenser of claim 1 wherein at least one of the settling vessels is a settling tube having an internal cross section of at least $1.5cm^2$.

6. The dispenser of claim 5 wherein the internal cross section is not more than about $7\ cm^2$.

7. The dispenser of claim 5 wherein the settling tube has a wall thickness of at least 1 mm.

8. The dispenser of claim 1 wherein each pump is a vacuum pump.

9. The dispenser of claim 1 wherein each pump is a pressure actuated pump configured to begin pumping the moment a pressure drop resultant from a dispensing outlet being opened is detected.

10. The dispenser of claim 1 including a fan and a tubular portion;

wherein the refrigerator includes a refrigeration mechanism for cooling air to form cooled air;

at least one of the fluid paths is partly defined by a portion of conduit embraced by the tubular portion; and the fan is arranged to move the cooled air through the tubular portion to cool the portion of the conduit.

11. The dispenser of claim 10 wherein the tubular portion is a portion of a fluid circuit about which air is circulated.

12. The dispenser of claim 11 wherein the fluid circuit includes an air-conveying conduit running along and within the tubular portion.

13. The dispenser of claim 12 including wherein the air-conveying conduit is a return line within which air that has cooled the portion of the conduit is returned to the refrigeration mechanism.

14. The dispenser of claim 10 including a font and wherein the tubular portion comprises a stem of the font.

15. The dispenser of claim 1 wherein the higher-temperature zone is substantially-fluidly-isolated from the lower-temperature zone, and the higher temperature zone is thermally connected to the lower-temperature zone by the floor, which is a thermally conductive.

16. The dispenser of claim 15 including:

a higher-temperature zone temperature sensor for sensing the temperature in the higher-temperature zone;

a heating apparatus for heating the higher-temperature zone; and a control arrangement for controlling the heating apparatus in response to the higher-temperature zone temperature sensor.

17. The dispenser of claim 16 including:

a lower-temperature zone temperature sensor for sensing the temperature in the lower-temperature zone;

a cooling apparatus for cooling the lower-temperature zone; and a control arrangement for controlling the cooling apparatus in response to the lower-temperature zone temperature sensor.

18. The beverage dispenser of claim 1 wherein each respective beverage unit outlet includes a respective membrane; and each respective inlet includes a respective tubular projection for penetrating a respective membrane, to form the respective dry break connection.

19. The beverage dispenser of claim 1 wherein at least one of the one or more beverage units is in the refrigerator and is holding wine.

* * * * *